US010527020B2

(12) United States Patent
Sugiura et al.

(10) Patent No.: US 10,527,020 B2
(45) Date of Patent: Jan. 7, 2020

(54) IGNITION APPARATUS FOR INTERNAL COMBUSTION ENGINES

(71) Applicant: DENSO CORPORATION, Kariya, Aichi-pref. (JP)

(72) Inventors: Akimitsu Sugiura, Kariya (JP); Kaori Doi, Kariya (JP); Yuki Murayama, Kariya (JP); Fumiaki Aoki, Nishio (JP); Noriaki Nishio, Nishio (JP)

(73) Assignee: DENSO CORPORATION, Kariya (JP)

( * ) Notice: Subject to any disclaimer, the term of this patent is extended or adjusted under 35 U.S.C. 154(b) by 295 days.

(21) Appl. No.: 15/667,923

(22) Filed: Aug. 3, 2017

(65) Prior Publication Data

US 2018/0038338 A1 Feb. 8, 2018

(30) Foreign Application Priority Data

Aug. 4, 2016 (JP) ..... 2016-153419

(51) Int. Cl.
*F02P 15/10* (2006.01)
*F02P 5/15* (2006.01)

(52) U.S. Cl.
CPC ..... *F02P 15/10* (2013.01); *F02P 5/15* (2013.01)

(58) Field of Classification Search
CPC ..... F02P 15/10; F02P 5/15
See application file for complete search history.

(56) References Cited

U.S. PATENT DOCUMENTS

2001/0035008 A1 11/2001 Nozawa et al.
2014/0345565 A1 11/2014 Mori

FOREIGN PATENT DOCUMENTS

JP 9-112398 4/1997
JP 2000-345950 12/2000
JP 2001-003845 1/2001
JP 2004-044495 2/2004

*Primary Examiner* — Xiao En Mo
(74) *Attorney, Agent, or Firm* — Nixon & Vanderhye P.C.

(57) ABSTRACT

An ignition apparatus for an internal combustion engine provided with an ignition coil and a spark plug. An ECU enables operation of a plurality of continuous discharges in the spark plug and also detects a flow speed of a combustible air/fuel mixture. In a first discharge, a supply of a primary current terminates the first discharge, with energy remaining in the ignition coil, from an initiation of the ignition to an initiation of the spark plug, when the detected flow speed exceeds a predetermined first threshold. Thereafter, a second discharge is performed by shutting off the primary current.

20 Claims, 15 Drawing Sheets

IGNITION APPARATUS FOR INTERNAL COMBUSTION ENGINES

CROSS-REFERENCE RELATED APPLICATION

The application is based on and claims the benefit of the priority of earlier Japanese application No. 2016-153419, filed on Aug. 4, 2016, the description of which is incorporated herein by reference.

BACKGROUND OF THE INVENTION

Technical Field

The present invention relates to an ignition apparatus for a combustion chamber of combustion engine, for an automotive vehicle, which is provided with an ignition coil and a spark plug. More specifically, the present invention relates to an ignition apparatus which is used to generate a plurality of ignition pulses to ignite an air/fuel mixture in the combustion engine.

Related Art

Lean burn engines provide improved fuel efficiency be operating with an excess of oxygen, that is, a quantity of oxygen that is greater than the amount necessary for complete combustion of the available fuel. When lean burn combustion, for example, exhaust gas recirculation (EGR) and homogenous lean burn is used, as disclosed in JP1997-112398A, an ignition apparatus configured to perform a plurality of ignition pulses for one cycle is known. In this way by performing a plurality of ignition pulses, if a combustible air/fuel mixture is not ignited by a first discharge, the combustible air/fuel mixture can be ignited by a second discharge, and combustion stability of an internal combustion engine can be enhanced.

In order to ignite the combustible air/fuel mixture by a discharge which is generated, the flow speed of a combustible air/fuel mixture in an internal combustion engine for example, is an important factor. That is, ignitability of the combustible air/fuel mixture is changed by the flow speed of the combustible air/fuel mixture in the internal combustion engine. More specifically, an increase in speed can in turn cause the ignitibility of the combustible air/fuel mixture to deteriorate as the ignition discharge is dissipated (blown out) as a result. In contrast, a decreased speed causing the ignitability of the combustible air/fuel mixture to deteriorate can occur as a discharge length of the ignition discharge is too short.

SUMMARY

In order to resolve the foregoing problems, the present disclosure aims to provide an ignition apparatus for an internal combustion engine (IC engine) configured to provide a plurality of ignition pulses in one cycle in which ignitability is enhanced by controlling the speed of the combustible air/fuel mixture in an internal combustion engine.

An ignition apparatus for an internal combustion engine is provided with an ignition coil having a primary coil and a secondary coil 10, and a spark plug which ignites a combustible air/fuel mixture by shutting off a primary current, after the primary current is passed through the primary coil, to generate an ignition discharge by a secondary voltage which is generated by the secondary coil. The ignition apparatus is also provided with a controller configured to perform a plurality of continuous discharges in the spark plug during initial combustion period which is from an initial time of the ignition until a combustion ratio of the fuel contained in the combustible air/fuel mixture has reached a predetermined value. The ignition apparatus is also provided with a speed detector which detects a flow speed of the combustible air/fuel mixture. When the speed detected by the speed detector exceeds a predetermined first threshold the controller is configured to terminate the first discharge by allowing a flow of the primary current, with energy remaining in the ignition coil for the first discharge at the spark plug, which is initiated from the initial time of ignition. Thereafter, a second discharge is implemented by shutting off the primary current.

If the flow speed exceeds the predetermined first threshold value, the spark discharge (discharge path) is expanded by an air flow, thus loss of the ignition discharge (blow off) can easily occur. Once the spark discharge is dissipated, a spark discharge is regenerated between electrodes of the spark plug. As the spark discharge is reformed around the spark plug, there is a large heat loss due to heat conduction to the spark plug, and as a result, the contribution to ignition is low. The ignition apparatus of the present disclosure is configured to terminate the first discharge, if the speed exceeds the predetermined first threshold, and keep energy remaining in the ignition coil. Thereafter, the remaining energy in the ignition coil can be reused and discharge regenerated.

In the case of the speed of exceeding the predetermined first threshold, energy accumulated in the ignition coil can be used for the second discharge by terminating the first discharge. As a result, energy which is accumulated in the ignition coil can be efficiently used for subsequent ignition pulses. Furthermore, by using the energy accumulated in the ignition coil, a charging period needed for a second ignition is decreased. More specifically, an interval between a first ignition and a second ignition is shortened, and a flame occurring when the first discharge is formed can be combined with a flame occurring when the second discharge is formed, as a consequence. Ignitability of the combustible air/fuel mixture can be thus enhanced.

Furthermore, a time from initiating the first discharge to completing of the second discharge can be decreased, and thus a plurality of ignition pulses reliably achieved, even when a rotating speed of an engine is high and an initial combustion period is short.

BRIEF DESCRIPTION OF THE DRAWINGS

In the accompanying drawings.

PREFERRED EMBODIMENTS

First Embodiment

Next preferred embodiments of the present disclosure will be described with reference to the drawings. In a first embodiment an ignition apparatus for a gasoline engine which is an internal combustion (IC) engine mounted in a vehicle is constructed. A spark discharge is generated in a spark plug based on an ignition command from an Electronic Control Unit (ECU) of the ignition apparatus. A schematic configuration of the ignition apparatus will now be described with reference to FIGS. 1(A) and (B).

Figure 1A:
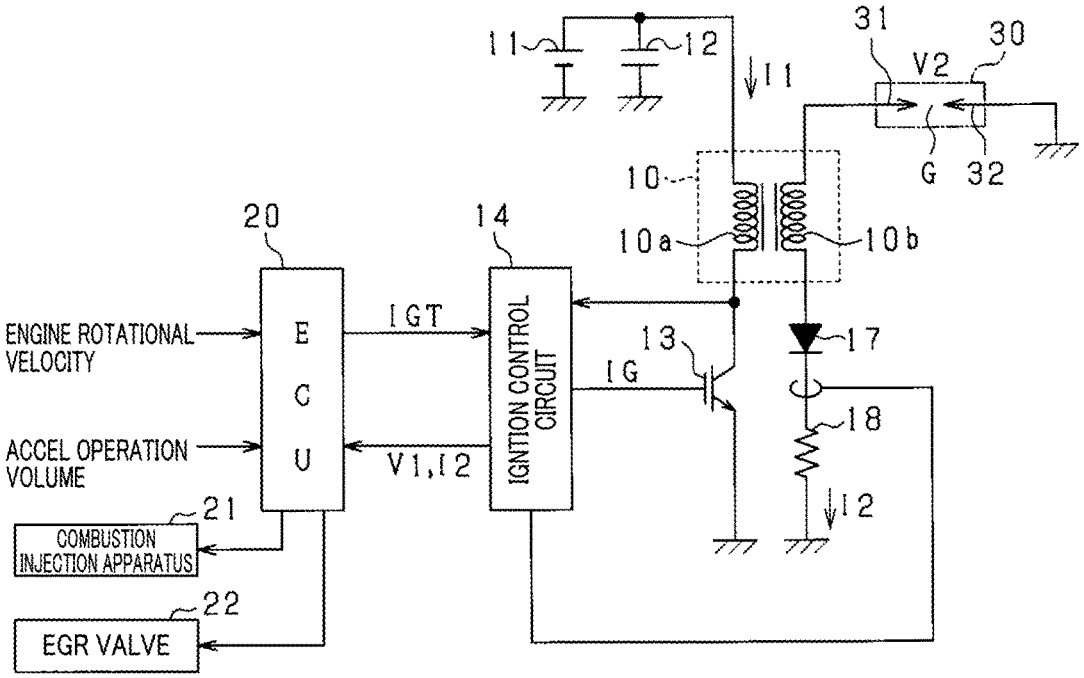
FIG. 1(A) shows a schematic view of an ignition control system and FIG. 1(B) shows a functional block diagram of an ECU.
Figure 1B:
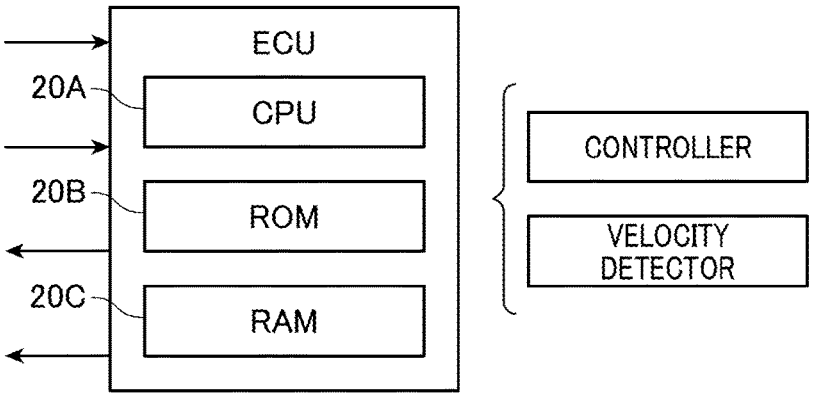

As shown in FIGS. 1(A) and (B), the ignition apparatus according to the first embodiment is provided with the ECU 20, an ignition control apparatus 14, a switching element 13, the ignition coil 10 and the spark plug 30.

In FIGS. 1(A) and (B), the ignition coil 10 is provided with a primary coil 10*a* and a secondary coil 10*b*, which is magnetically connected to the primary coil 10*a*. A first end of two ends of the primary coil 10*a* is connected to a positive electrode side of a battery 11, another end referred to as a second end, is ground connected through a input/output terminal of a switching element 13 which is an opening and closing means of an electronic control. The positive electrode side of the battery 11 is connected to a condenser 12. A bipolar transistor, Metal Oxide Semiconductor field effect transistor (MOSFET), and an Insulated Gate Polar transistor (IGBT), for example, is used as the switching element 13. It is noted that the battery 11 may be, for example, a Pb (lead) storage battery for mounting in a vehicle.

A gate of the switching element 13 is connected to an ignition control circuit 14. The ignition control circuit 14 is configured to control an ON/OFF control of the switching element 13. A first end of two ends of the secondary coil 10*b* is connected to a main electrode 31 (negative) of the spark plug 30, and another side referred to as a second end is ground connected through a diode 17 and a resistor 18. A ground electrode 32 (anode) of the spark plug 30 opposes the main electrode 31.

A detection voltage of the resistor 18, specifically a detection value of a secondary current I2 is inputted into the ignition control circuit 14. A detection value of a primary voltage V1 generated at the primary coil 10*a* is input into the ignition control circuit 14. The detected value of the secondary current I2 and the detected value of the primary voltage V1 are notified to the ECU from the ignition control circuit 14.

The ECU 20 is mainly configured of microcomputer having a known CPU (Central Processing Unit) 20A, a RAM (Random Access Memory) 20B, and a ROM (Read Only Memory) 20C, for example. The ECU 20 (i.e., the CPU 20A) performs each type of control, for example a control for fuel injection and ignition according to an engine driving state, by executing each control program (which includes control of the speed detection) previously stored in the ROM 21C. At an ignition control period the ECU 20 acquires driving state information indicating a rotation speed of an engine, and operational amount of acceleration, for example, and calculates an optimum ignition period based on the acquired driving state information. The ECU generates an ignition pulse signal IGT which corresponding to the ignition period, and outputs the ignition pulse signal IGT to the ignition control circuit 14. The ECU also controls a fuel injection apparatus 21 which injects fuel into a combustion chamber of the engine.

Although omitted from the figures, a part of exhaust gas emitted to an exhaust pathway is reflux to a suction pathway via an EGR pathway. An EGR valve 22 is disposed on the EGR pathway. A part of the exhaust gas emitted to the exhaust pathway is supplied to the intake pathway as outside EGR gas, after being cooled by the EGR cooler according to an opening of the EGR valve 22. The ECU 20 controls an amount of external EGR gas supplied, by adjusting an opening of the EGR valve 22 based on the driving conditions (engine load and rotating speed).

The ignition control circuit 14 outputs a driving signal IG to switch-on the switching element 13 via a switching on of the ignition pulse signal IGT input from the ECU20, the switching element 13 is thus switched on. As a result, power to the primary coil 10*a* is initiated from the battery 11 and magnetic energy is accumulated in the ignition coil 10.

Once the driving signal IG is switched to an off signal, the switching element 13 switches to an off state, and a high secondary voltage V2 is generated at both ends of the secondary coil 10*b* by an electromagnetic induction. Additionally, a spark discharge is generated in the gap G when an insulation breakdown is caused at a gap G of the spark plug 30 by the high secondary voltage V2. When the spark discharge occurs, a discharge current (specifically the secondary current I2) flows to the gap G and a flame kernel is produced. Thereafter, combustion is generated by propagation of the flame kernel (specifically, and initial flame) around the air/fuel mixture.

In the first embodiment, under leaner air/fuel ratio (A/F) (lean burn) conditions than a theoretical A/F ratio, and also under high EGF rate conditions, pluralities of continuous discharges (ignition) are performed by the spark plug 30. More specifically, the plurality of continuous discharges (ignition) are produced by the spark plug, over an initial combustion period which is a period from an initial ignition time period until a fuel combustion percentage contained in the air/fuel mixtures reaches a threshold in lean burn regions. As a result, when the air/fuel mixture is not ignited by the first discharge, the air/fuel mixture can be ignited by the second discharge. It is noted that the EGR rate refers to an amount of exhaust gas flowing in a combustion chamber of an engine, divided by the sum of the amount of exhaust gas flowing in the combustion chamber of the engine and an amount of air flowing into the combustion chamber of the engine.

Incidentally, if an airflow occurs inside a cylinder, the discharge path in which the spark discharge occurs, flows downstream with the air flow and dissipation of the discharge path occurs as a consequence. In such a case, there are three ways (modes) in which a discharge path is dissipated.

Figure 2A:
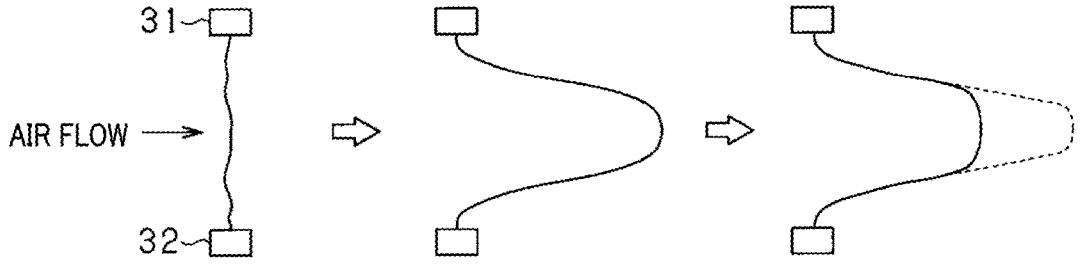
FIG. 2(A), FIG. 2(B) and FIG. 2(C) are diagrams showing a formational change of a discharge when a (discharge) path is dissipated.
Figure 2B:
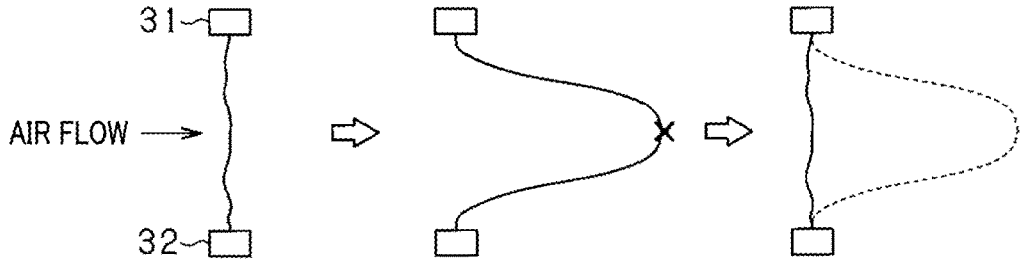
Figure 2C:
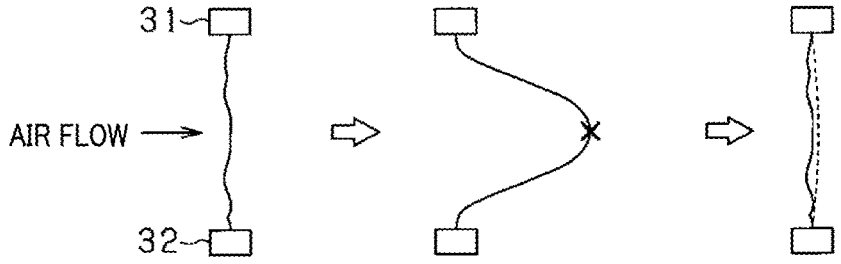
Figure 3A:
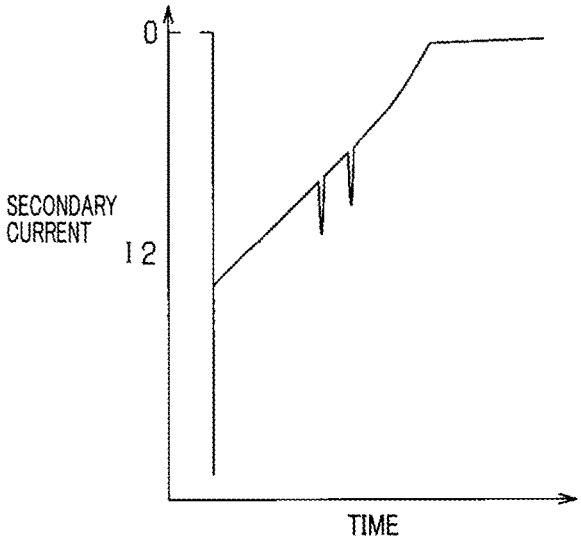
FIG. 3(A), FIG. 3(B) and FIG. 3(C) are diagrams showing changes of waveforms of a secondary current I2 when a path is dissipated.
Figure 3B:
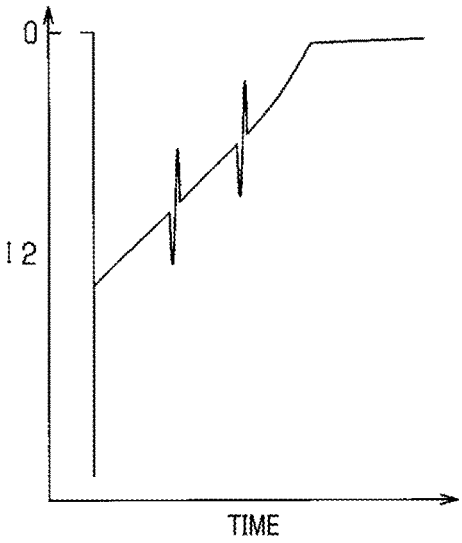
Figure 3C:
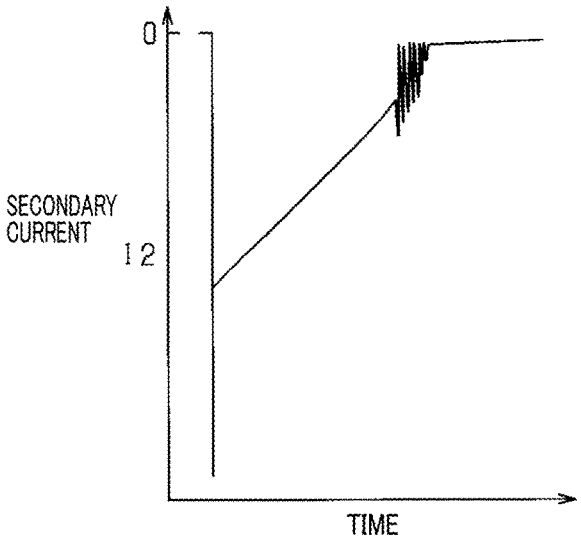

Next, the three modes in which the discharge path is dissipated is described using FIGS. 2(A)-2(C) and FIGS. 3(A)-3(C). FIGS. 2(A) to 2(C) show the three modes in which the discharge path is dissipated. In the FIGS. 2(A) to 2(C) a changing form of the spark discharge in relation to time from a point in which the discharge is initiated until the same discharge dissipates is shown. FIGS. 3(A) to 3(C) each show waveforms changing with time in relation to the secondary current I2, from when the insulation break down occurs until the discharge path is dissipated, which was monitored simultaneously for the three modes mentioned above. It is noted that, the changing formation of the spark discharges shown in FIGS. 2(A) to 2(C) each correspond to the changing waveform of the secondary current I2 each shown in the respective FIGS. 3(A) to 3(C).

In FIG. 2(A), firstly an insulation breakdown occurs and the spark discharge is generated in the gap G. Once an airflow shown with an arrow occurs in the cylinder, the discharge path extends downstream with the air flow. Thereafter, a middle section of the discharge is short circuited and a part of the discharge path dissipated. Specifically a short-circuited discharge occurs. With reference to FIG. 3(A) at this point, after an increase of the secondary current I2 with the initial time of the discharge, the secondary current I2 suddenly decreases temporarily, with the occurrence of the short-circuit discharge, whilst gradually decreasing. It is noted that, after the short-circuit discharge, if the remaining energy in the ignition coil 10 is high, extension of a discharge path of the short circuit discharge will reoccur.

In FIG. 2(B), after the spark discharge is generated, the discharge path will extend downstream with the airflow, which is caused by a strong airflow occurring in the cylinder. The secondary current I2 will decrease to a predetermined value, and once the discharge is broken the total discharge path is temporarily dissipated, that is, the so called [blow off] of the discharge occurs. Now referring to FIG. 3B, at this point due to the blow off of the discharge path occurring, a sudden decrease of the secondary voltage I2 is immediately followed by a sudden increase. It is noted that after the blow off occurs, when the remaining energy in the ignition coil 10 is high, extension and blow off of the discharge path will reoccur, after a spark discharge is generated.

In FIG. 2(C), the blow off of the discharge is caused by a low secondary current I2. Specifically, even if the discharge path is only merely extended by weak airflow, the blow off effect of the discharge will occur if the secondary current I2 is low. In such a case, the insulation break down between electrodes at the gap G will occur and a spark discharge reoccur immediately after the blow off occurs. Since energy remaining in the in the ignition coil 10 is low, the blow off of the discharge will reoccur. As shown in FIG. 3(C), reoccurrence of the blow off of the discharge and generation of the spark in turn causes a sudden decrease immediately followed by a sudden increase of the secondary current I2 which reoccurs at a high frequency.

The short-circuit discharge occurs in relation to the speed inside the cylinder and has a low dependency on the secondary current I2. In contrast, the blow off effect is dependent to the secondary current I2. That is specifically, it is considered that the blow off effect occurs when the secondary current I2 falls below a predetermined value, known as a blow off current value, corresponding to the strength of the airflow. It is considered that in the case of the secondary current I2 being a large current in which the blow off the effect will not occur, a time period from the initial discharge until the short-circuit discharge occurs changes in accordance with the cylinder speed and is independent of the size of the secondary current I2.

Figure 4:
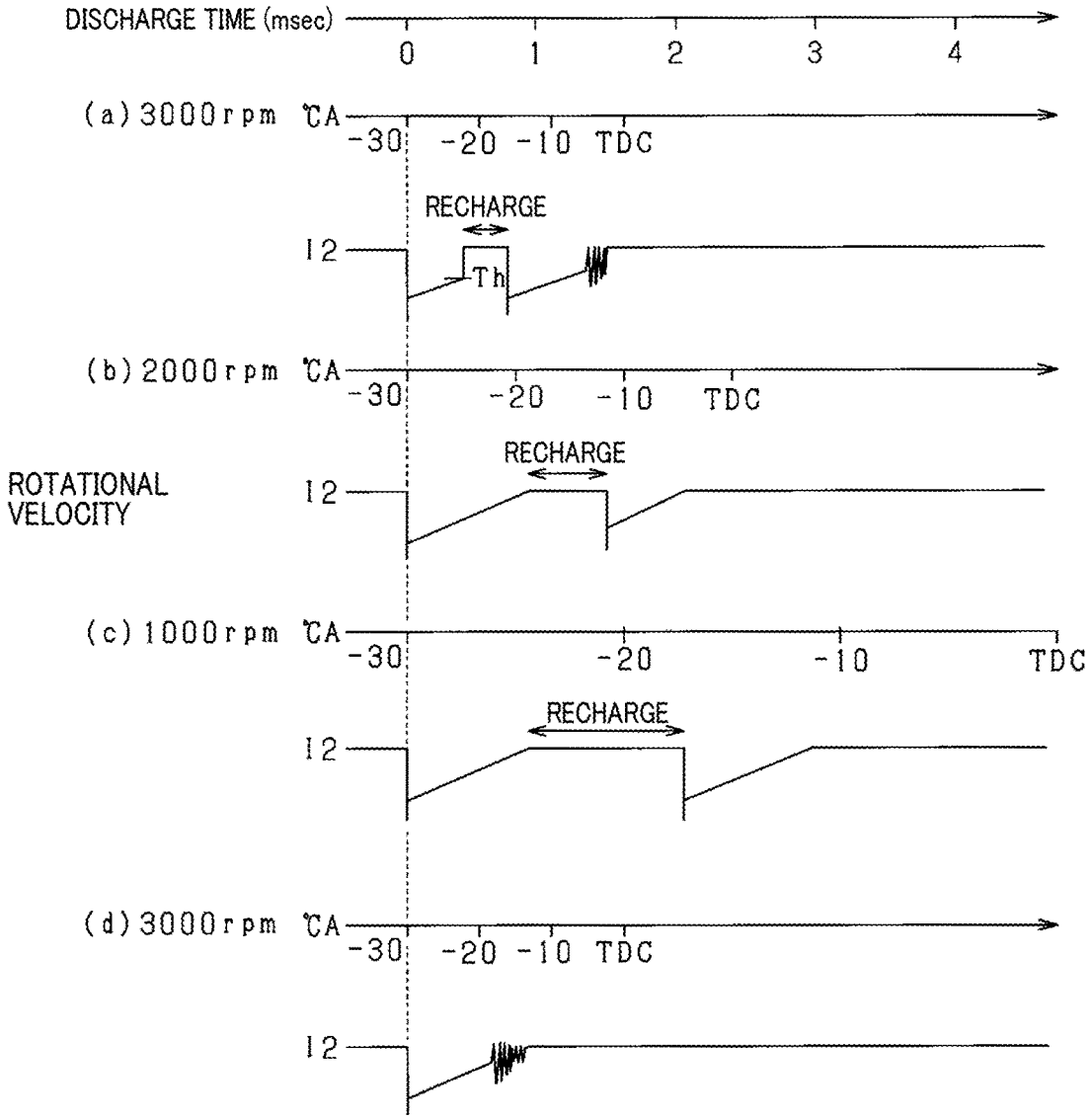
FIG. 4 are time charts showing discharge patterns of a first embodiment.

At this point, in the ECU 20 which is the controller of the first embodiment performs an ignition control shown in FIGS. 4(*a*), (*b*), (*c*) and (*d*). In the example shown in FIG. 4(*a*) the rotating speed of an engine is 3000 rpm (rotations per minute) and the higher the rotating speed of the engine is, the higher a flow speed of the air/fuel mixture is. The flow speed of the air/fuel mixture is also simply referred to as the speed of the air/fuel mixture hereon.

When the speed of the engine exceeds a predetermined first threshold, the spark discharge is subjected to blow off and the spark discharge regenerates in the gap G of the spark plug 30. As the spark discharge regenerates around the spark plug 30, a loss of heat from thermal conductivity to the spark plug 30 is large, thus contribution to the ignition is low.

In this regard, as shown in FIG. 4(*a*), the ECU 20 terminates the first discharge before the blow off of the spark discharge (with energy remaining in the ignition coil 10). Furthermore, the ECU 20 is configured so that, reoccurrence of the discharge is produced after the same amount of energy (predetermined energy) which was accumulated at the initial point of the first discharge is accumulated in the ignition coil 10.

Specifically, the ECU 20 is configured to terminate the discharge by switching on the switching element 13 (electrically supplying the primary current I1), before the secondary current I2 reaches a determination value which predicts an occurrence of the blow off of the spark discharge. As a result, the discharge can be terminated before the blow off of the spark discharge occurs. Additionally, the ECU 20 sets the determination value at a high value, the value of which predicts the occurrence of the spark discharge blow off. More specifically, the predetermined value is an indication for the occurrence of the blow off of the spark plug discharge. A method to determine the speed of air/fuel mixture will be described later.

Figure 16A:
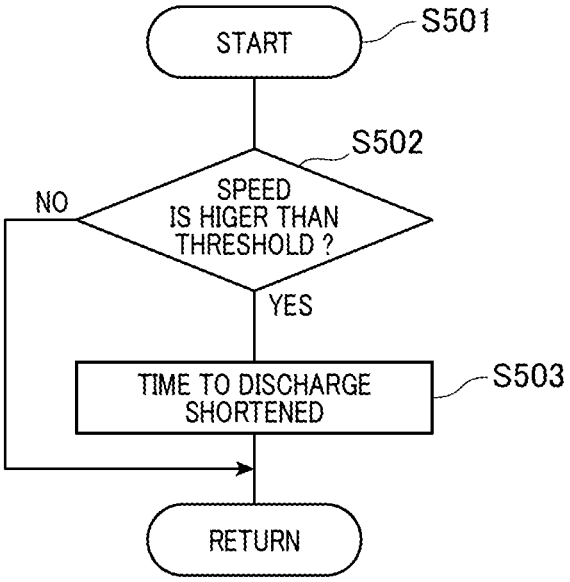
FIGS. 16(A), FIG. 16(B), FIG. 16(C) and FIG. 16(D) are flow charts showing in FIG. 16(A) steps of a process for shortening time from an initial time of an ignition to termination of the first discharge, in FIG. 16(B) steps of a process for generating the first discharge and the second discharge, in FIG. 16(C) steps of a process for continuously generating the first discharge, and in FIG. 16(D) a process for generating the first discharge when the speed exceeds a second threshold, according to the first embodiment.

Next, a process shown in FIG. 16(A) of setting the time period from the initial time of the ignition to the termination of the first discharge is described.

At step 501, the speed of the air/fuel mixture is determined using a speed determination means which determines whether the speed is higher than the predetermined threshold. At step 502, if the speed is determined to be higher than the predetermined first threshold (step 502; YES), (i.e. >than the first threshold) the ECU sets the period from the initial time of ignition to the termination of the first discharge to be shorter at step 503, compared to when the speed is lower than the predetermined threshold for the first discharge. Specifically, the higher the speed is the higher the threshold of the secondary current I2 used to determine the blow off of the spark discharge is set. As a result, the first discharge can be terminated reliably before the blow off of the spark discharge occurs. The step 501 functionally corresponds to a first determining means, step 502 corresponds to a first comparing means and step 503 functionally realizes a shortening means in the first embodiment.

Additionally, the higher the speed, the shorter the time of the first discharge is, and also the energy remaining in the ignition coil 10 can be largely used for the second discharge. As a further result, a charging time needed for the second discharge, that is, a termination time of the discharge, after the first discharge is shorter and the initial flame occurring at both respective first and second discharge periods can be combined with higher certainty. The period from when the first discharge is initiated until the second discharge is complete is thus shorter, and a plurality of ignition pulses can performed, even when the rotating velocity of the engine is high and an initial combustion period is short.

Figure 16B:
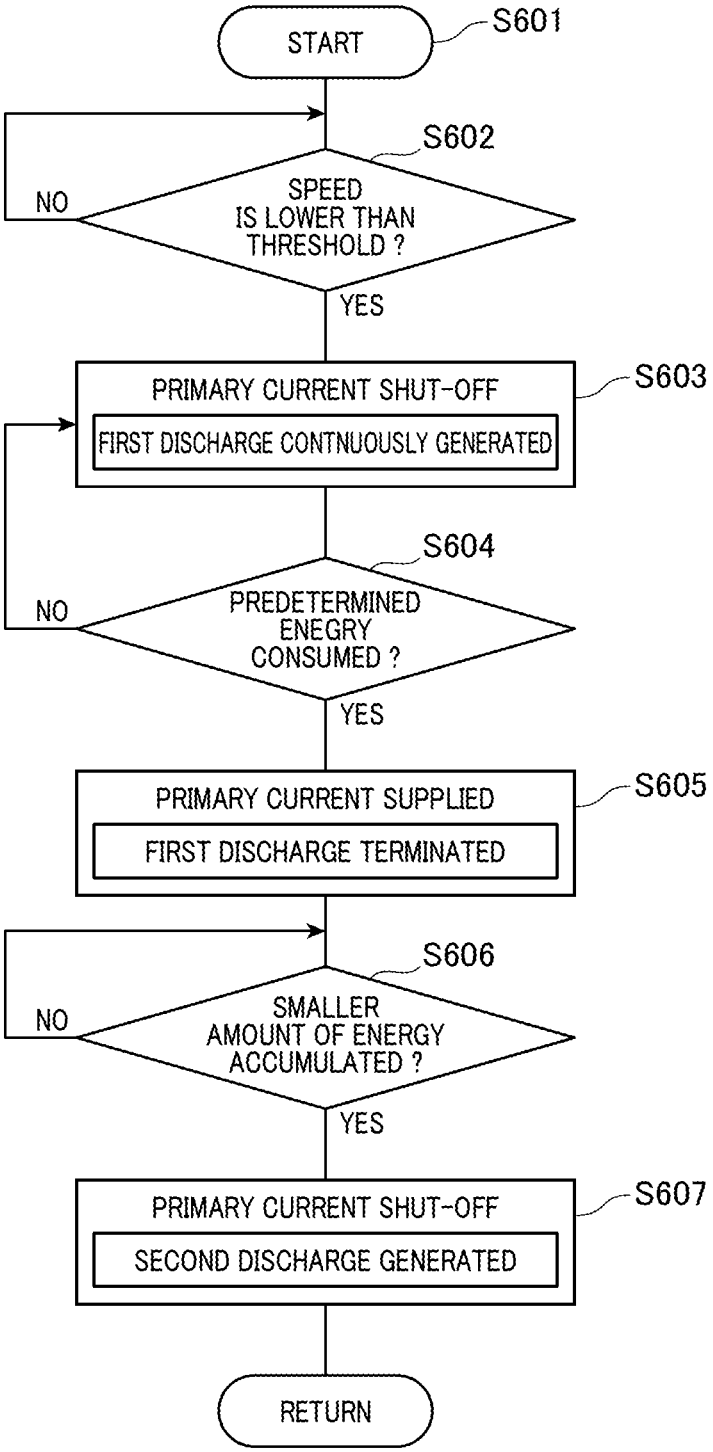

Next, with reference to FIG. 16(B) a process of the discharge pattern shown in FIG. 4(*b*) is described. At step 601 the speed of the air/fuel mixture is determined using the speed determining means. When the speed of the air/fuel mixture is determined to be lower than the predetermined first threshold (step 602; YES) blow off of the spark caused by the airflow is almost non-existent. At step 603, the primary current is shut off and the first discharge is continuously generated, until the predetermined energy is consumed (step 604; YES). Specifically, the primary current is shut off until the total accumulated energy in the ignition coil 10 is consumed. Next, at step 605, the primary current is supplied, and when a smaller amount of energy than the predetermined energy is accumulated in the ignition coil (step 606; YES) the primary current is shut off step 607. In this way, the charging time for the second discharge STEP 609 is decreased, by accumulation of a smaller amount of energy for the second discharge than the first discharge (predetermined energy). The interval between the first discharge and the second discharge is thus shorter and combining of the initial flames generated at the respective first discharge and second discharge is thus enabled. Enhancement of the ignitability of the combustible air/fuel mixture can be obtained. Also, decreasing the time period from the initial first discharge to the completion of the second discharge is achieved, and the plurality of ignition pulses can be performed with higher certainty, even when the engine rotating speed is high and the initial combustion period short.

The step 601 functionally corresponds to second determining means, the step 602 corresponds to a second comparing means, step 603 functionally realizes the shutting off of the primary current, until the predetermined energy is consumed which is determined by a judging means at step 604 in the first embodiment. The step 605 functionally realizes the supply of the primary current the step 606 corresponds to a third comparing means and the step 607 functionally realizes the shutting off of the primary current when energy smaller than the predetermined energy is accumulated in the ignition coil 10.

Figure 16C:
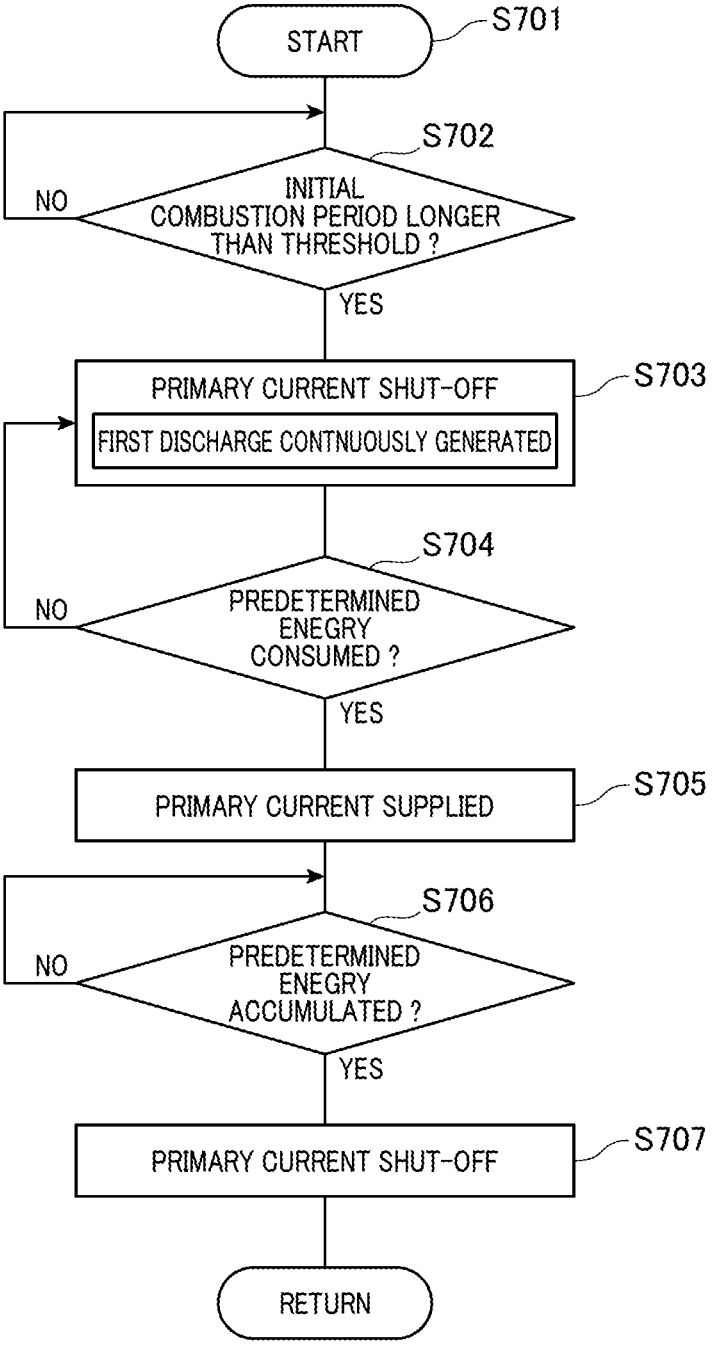

As shown in FIG. 4(*c*) the ECU 20 controls operation of the first discharge whereby the first discharge is continuously generated. Specifically, with reference to FIG. 16(C), when the length of the initial combustion is determined to be longer than predetermined value, YES at step 702, the primary current is continuously shut off at step 703, until the predetermined energy is completely consumed, during which time the first discharge is continuously generated (step 703). Once the total energy in the ignition coil 10 is consumed, i.e. YES at step 704, the primary current is supplied at step 705 until the predetermined energy is accumulated in the ignition coil 10, YES at step 706, at which point the primary current is shut off at step 707. That is, the predetermined energy is charged during the second discharge, when the length of the initial combustion is higher than predetermined value, and a discharge is generated consuming the total energy accumulated even when the speed falls below the first threshold. The predetermined value used to determine the length of initial combustion period is set such that the rotating speed of the engine is low, and to enable determination of whether the ignition combustion period is sufficiently long in which the predetermined energy can provide more than two discharges. In this configuration, in a case of a low rotating speed where the discharge path extends only with difficulty, a total value of both a discharge energy and discharge time in the spark plug 30 is maximized, and ignitability of the combustible air/fuel mixture can also be enhanced.

In the above described, the step 701 functionally corresponds to a fourth determination means of the first embodiment. The step 702 is a fourth comparing means, step 703 and step 707 functionally actualize the shut off of the primary current, step 704 functionally actualizes continuous generation of the first discharge, step 706 is second judging means, and step 707 functionally actualizes the flow of the primary current in the first embodiment.

Figure 16D:
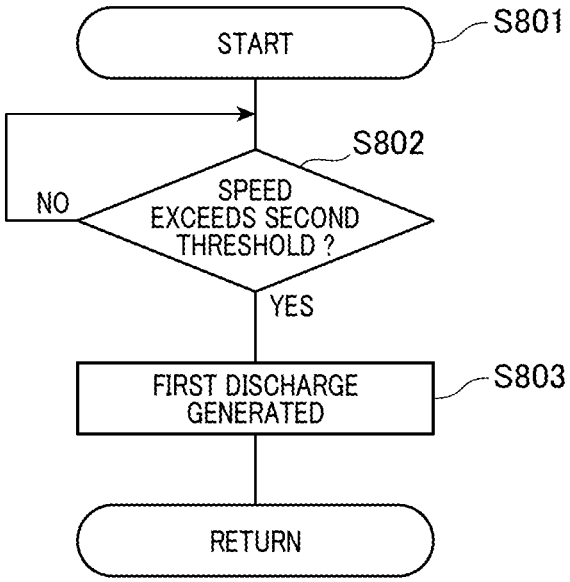

Additionally, the higher the speed rotating velocity of the engine, the lower the ignitability of the air/fuel mixture is, and enhancement of the propagation of the initial flame increases the combustibility of the air/fuel mixture. At this point, as shown in FIG. 4(*d*), and in the flow chart shown in FIG. 16(D) the ECU 20 is configured to operate only the first discharge, under conditions of the speed exceeding the second threshold (and >than the first threshold). Specifically the speed of the air/fuel mixture is determined step 801, and when the speed is determined to exceed the second threshold (YES at step 802) only the first discharge is generated at step 803. As a result, whilst securing the combustibility of the air/fuel mixture, deterioration of the spark plug 30 can be decreased. In the fourth process the step 801 is the means for determining the speed of the air/fuel ratio, the step 802 is a fifth comparing means and the step 803 functionally actualizes the generation of the first discharge only.

Figure 6:
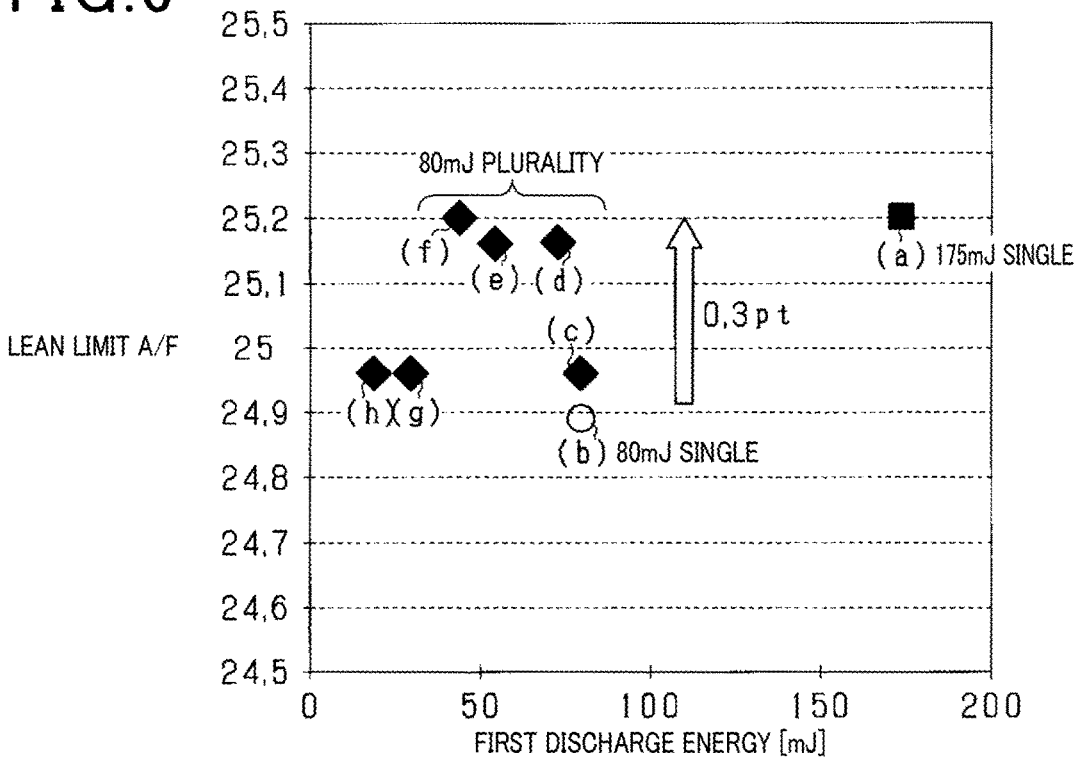
FIG. 6 is a diagram showing correspondence of energy used for a first discharge and a lean limit air/fuel ratio.
Figure 7:
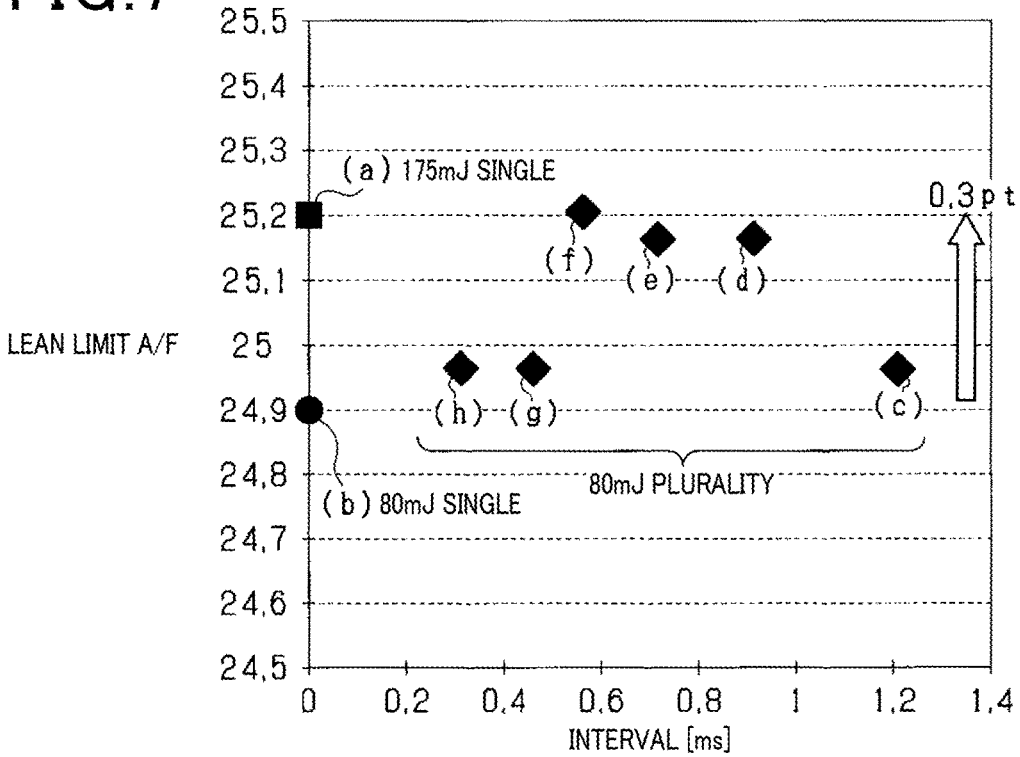
FIG. 7 is a diagram showing a correspondence of a time interval

Next, effects of the configuration in which the first discharge is terminated before the blow off of the spark discharge occurs and a discharge is re-generated after energy is accumulated in the ignition coil will be described referring to FIGS. 5 to 7. The FIG. 5(*a*) to (*h*) show eight types of discharge patterns and FIGS. 6 and 7 show a respective lean limit air/fuel ratio for each of the discharge patterns shown in FIG. 5(*a*) to (*h*).

The lean limit value of the air/fuel ratio is an upper limit of the air/fuel ratio, which is less than predetermined variable value of a mean effective pressure(for example 3%). Additionally, the mean effective pressure refers to the operation of piston in the combustion of the air/fuel mixture for 1 cycle of combustion in the engine in which the operation of the piston is divided by a capacitive stroke. Additionally, the discharge patterns (a), and (c) to (h), each show a predefined approximately 80 mJ accumulating in the ignition coil. At this point, the ignition coil 10 is configured so that a charging time of less than 1.2 msec is used to charge a maximum energy accumulation of approximately 80 mJ in the ignition coil when an output voltage of the battery 11 is from 12 to 14 V.

Figure 5:
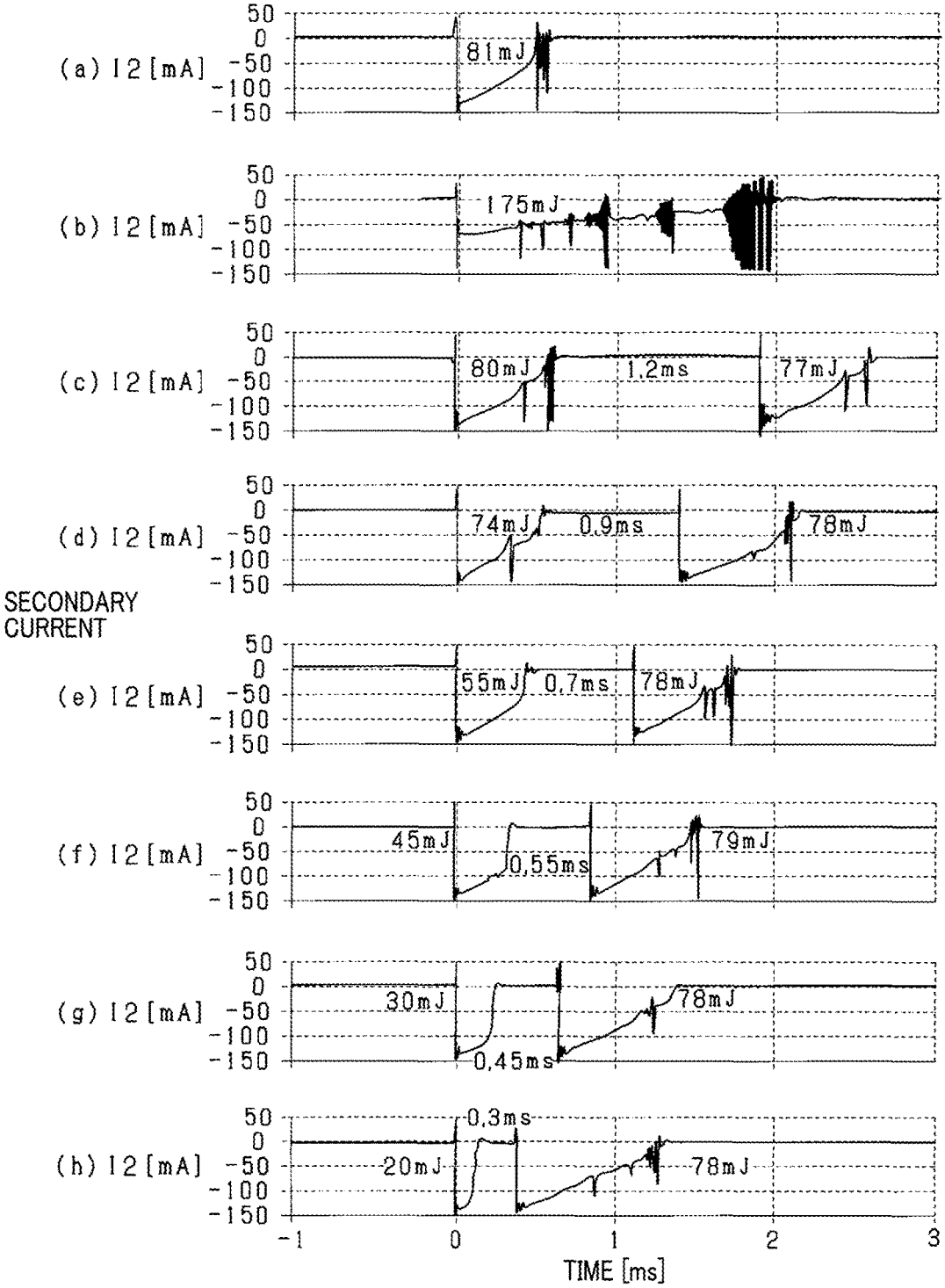
FIG. 5 are time charts showing a pattern of each discharge.

As shown in FIG. 5(*a*), the discharge pattern is produced only once, during which approximately 80 mJ (81 mJ) of energy is discharged. In the discharge pattern (b) a discharge is produced only once, during which approximately 175 mJ of energy is discharged.

In the discharge pattern (c) of FIG. 5, the discharge is produced twice, during which approximately 80 mJ (80 mJ ) of energy is discharged in the first discharge and approximately 80 mJ (77 mJ) of energy is discharged in the second discharge. In this case, a charging time of approximately 1.2 msec to the ignition coil 10 is necessary after the first discharge, and as a result an interval of 1.3 msec occurs between the first discharge and the second discharge occurs.

In the discharge pattern (d) of FIG. 5, the discharge is produced, and approximately 74 mJ of energy is discharged in the first discharge and approximately 80 mJ (78 mJ) of energy is discharged in the second discharge. In this case, a charging time of approximately 0.9 msec to the ignition coil is necessary after the first discharge, thus an interval of approximately 0.9 msec occurs between the first and second discharge. Furthermore, the first discharge is terminated before the short circuit of the spark discharge occurs.

In the discharge pattern (e) of FIG. 5, two discharges are produced, and approximately 55 mJ of energy is discharged in the first discharge and approximately 80 mJ (78 mJ ) of energy is discharged in the second discharge. In this case, a charging time of approximately 0.7 msec to the ignition coil is necessary after the first discharge, thus an interval of approximately 0.7 msec occurs between the first and second discharge. In the discharge pattern of FIG. 5 the first discharge is terminated before the blow off of the spark discharge occurs.

In the discharge pattern (f) of FIG. 5, two discharges are produced, and approximately 45 mJ of energy discharged in the first discharge and approximately 80 mJ (79 mJ ) of energy discharged in the second discharge. In this case, a charging time of approximately 0.55 msec is necessary after the first discharge, thus an interval of approximately 0.55 msec occurs between the first and second discharge. In the discharge pattern of FIG. 5 the first discharge is terminated before the blow off of the spark discharge occurs.

In the discharge pattern (g) of FIG. 5, two discharges are produced, and approximately 30 mJ of energy discharged in the first discharge and approximately 80 mJ (78 mJ ) of energy discharged in the second discharge. In this case, a charging time of approximately 0.45 msec for the ignition coil 10 is necessary after the first discharge, thus an interval of approximately 0.45 msec occurs between the first and second discharge. In the discharge pattern (g) the first discharge is terminated before the blow off of the spark discharge occurs.

In the discharge pattern (h) two discharges are produced, and approximately 20 mJ of energy is discharged in the first discharge and approximately 80 mJ (78 mJ ) of energy is discharged in the second discharge. In this case, a charging time of approximately 0.3 msec for the ignition coil 10 is necessary after the first discharge, thus an interval of approximately 0.3 msec occurs between the first and second discharge. In the discharge pattern (h) the first discharge is terminated before the blow off of the spark discharge occurs.

A correspondence of discharged energy and air/fuel ratio lean limit value in the first discharge are shown in FIG. 6. The discharge patterns (d) (e) and (f) which have larger discharge patterns than a substantial half of the predetermined energy (80 mJ ) of energy discharged in the first discharge, have an air/fuel ratio lean limit value of 24.9 increasing by 0.3 to 25.2, compared with the discharge pattern of (a). On the other hand, the discharge patterns (g) and (h) which have smaller discharge patterns than a substantial half of the predetermined energy (80 mJ ) discharged in the first discharge have air/fuel lean limit values that have almost not increased from 24.9 compared with (a). In the first discharge, the discharged energy is smaller than the predetermined value, thus the initial flame of the first discharge will not grow. As a result, it is considered that the ignitability is not enhanced.

A correspondence of the time interval between the first discharge and the second discharge, and the lean limit value of the air/fuel ratio of the first and second discharges are shown in FIG. 7. The discharge patterns (d) (e) and (f) which have a shorter time interval than 0.9 msec have a lean limit value of air/fuel ratio of a substantial 25.2 increased by 0.3 from 24.9. In contrast, the discharge pattern (c) in FIG. 7 having a time interval 1.2 msec is almost unchanged compared with the discharge pattern of (a). In this case, if the time interval is long, the initial flame generated at the second discharge and the initial flame generated by the first discharge will not combine with each other. As a result, it is considered that the ignitability will not be enhanced.

Figure 8:
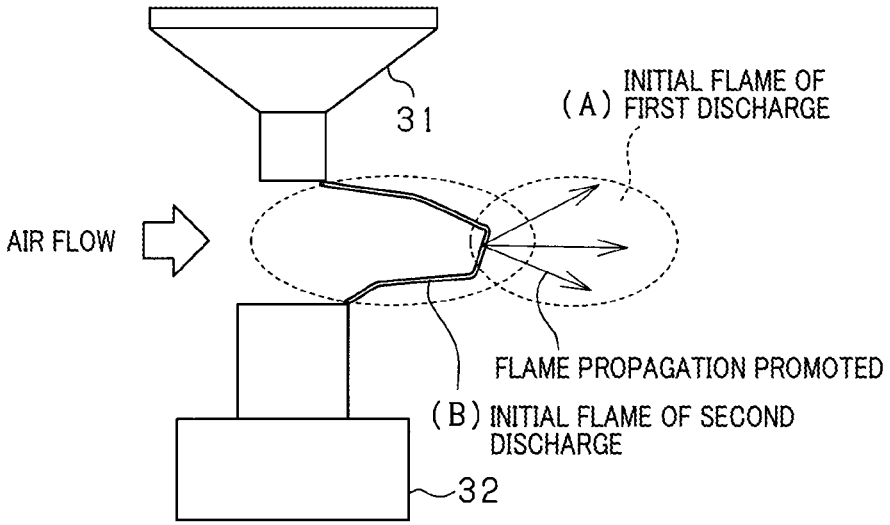
FIG. 8 is scheme view showing an initial flame of a second discharge propagated by an initial flame of the first discharge.

As shown in FIG. 8, if the size of the initial flame of the first discharge is sufficiently large, and the time interval between the first discharge and the second discharge is less than the predetermined value, it is considered that the initial flames of the respective first and second discharges will combine. Once the initial flames generated at the respective first and second discharges are combined, propagation of the initial flame generated at the second discharge is enhanced by the initial flame of the first discharge or the ignitability is enhanced by enhanced propagation of the initial flames generated at the respective first and second discharges.

Figure 9:
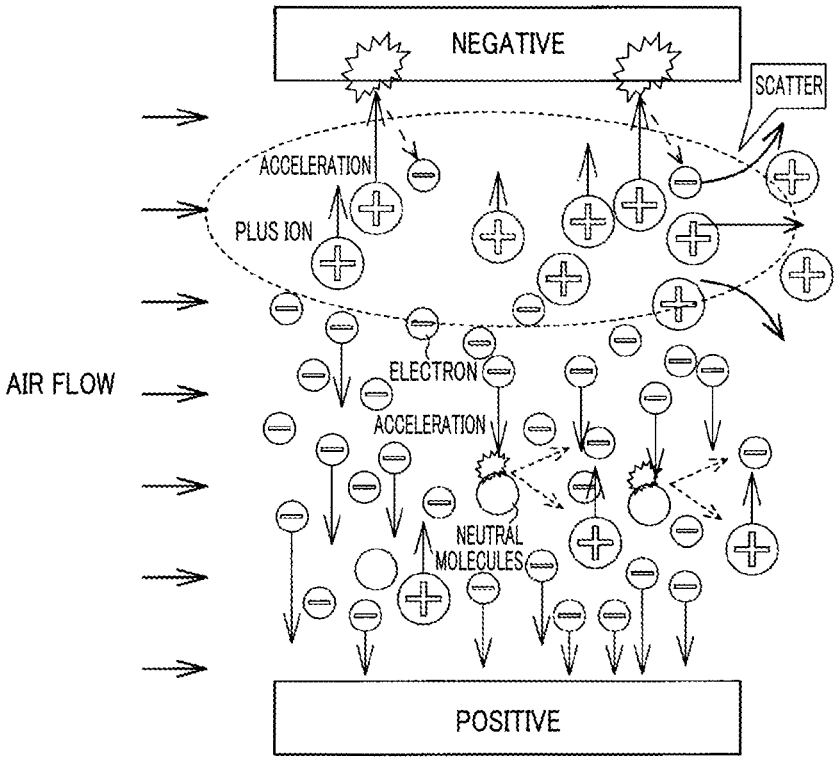
FIG. 9 is a scheme view showing a phenomena of electron avalanche of a spark plug.

Next, detection of the speed of the air/fuel mixture is described using FIGS. 9 to 12. The FIG. 9 shows a gap G of the air/fuel mixture state. As shown in FIG. 9, free electrons exist (initial electrons). Once a high voltage is applied to the gap G, the initial electrons increase speed due to the electric field, and collide with neutral gas molecules. As a result of the collision of the initial electrons and the gas molecules, electrons are ionized from the gas molecules and positive ions are generated ($\alpha$ working effect). Additionally the generated positive ions is attracted to the main electrode when a negative voltage is applied, and secondary electrons are discharged ($\gamma$ working effect) from the main electrode 31 as a result of the collision with the main electrode 31.

As, the alpha effect is generated in a space around the center electrode 31, a density of the positive ion increases around the center electrode 31. When the positive ion increases around the center electrode, the electric field strength increases between the main electrode 31 and the plus ions existing near to the center electrode. As a result, an electron avalanche phenomena is stimulated and the spark discharge in the gap G thus generated.

At this point if the discharge is repeatedly generated, and a large number of the initial electrons are remain in the gap G due to the previous discharge, ionization of gas molecules is accelerated and electron avalanche occurs easily, compared to when the initial electrons from the discharge do not remain, from a point of the application of the high voltage to the a point in which the spark discharge is generated. As a result, the insulation break down in the gap G is easily generated and the discharge thus easily generated as a further result. Specifically, if the same voltage is applied to the gap G, the lower the speed of the air/fuel mixture is, the easier the electron avalanche occurs. Also, the lower the speed of the air/fuel is, the lower a value of the voltage is (that is, an initial discharge voltage) generated at an initial point of the discharge capacity in the gap G, or at the initial point of the spark discharge. At this point, the ECU 20, which is the speed detector 20M (flow speed detector) in the first embodiment, is configured to operate both the flow and shut off of the primary current I1, and to detect the flow speed of the air/fuel mixture based on the basis of a size of the discharge initial voltage to the spark plug 3—due to the shut off of the primary current I1.

Figure 10:
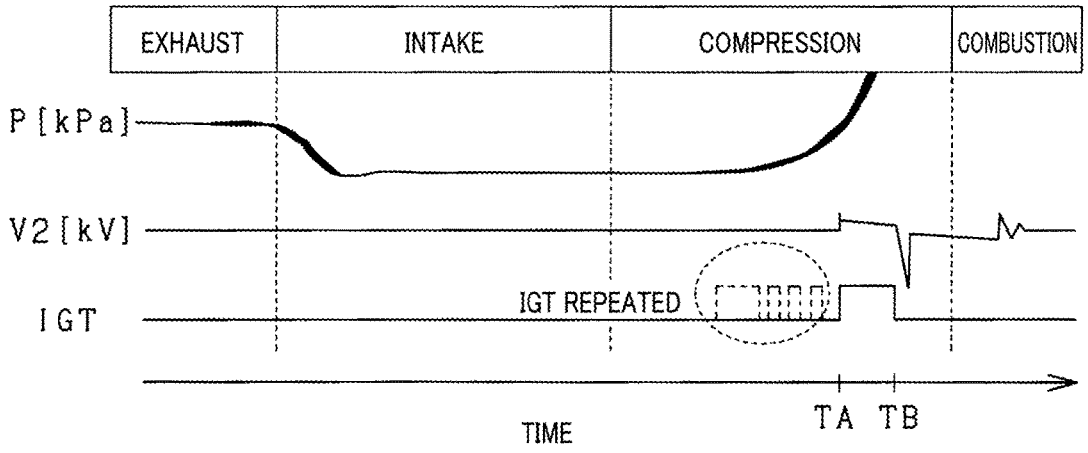
FIG. 10 is a time chart showing a change of a spark plug signal and a secondary voltage of a first engine cycle.

In FIG. 10, a time chart of a pressure P of the combustion chamber and change of the ignition signal IGT of a first operational cycle of the engine are shown. The first operational cycle is configured of an intake process, a compression process, a combustion process and an exhaust process.

In the operation cycle, the pressure P decreases by moving to the intake stroke from the exhaust stroke. Thereafter, the piston rises at the compression stroke whereby the air/fuel mixture is compressed and the pressure P increases. At the time TA during the compression stroke, the ignition signal IGT is switched on and primary coil 10*a* is charged to flow at which point the secondary voltage V2 (on voltage) is generated. At the time TB during the compression stroke, the ignition signal IGT is switched off and a reversed polarity of high secondary voltage is generated. The spark plug 30 is initiated by the insulation break down at the gap G.

In the first embodiment, a capacitive discharge or an ignition discharge is generated by repeatedly switching the spark ignition signal on and off before the initial time of ignition at the compression stroke. Next, the air/fuel speed is detected based on the size of the secondary voltage V2 when the capacitive discharge of the ignition discharge is generated.

Figure 11:
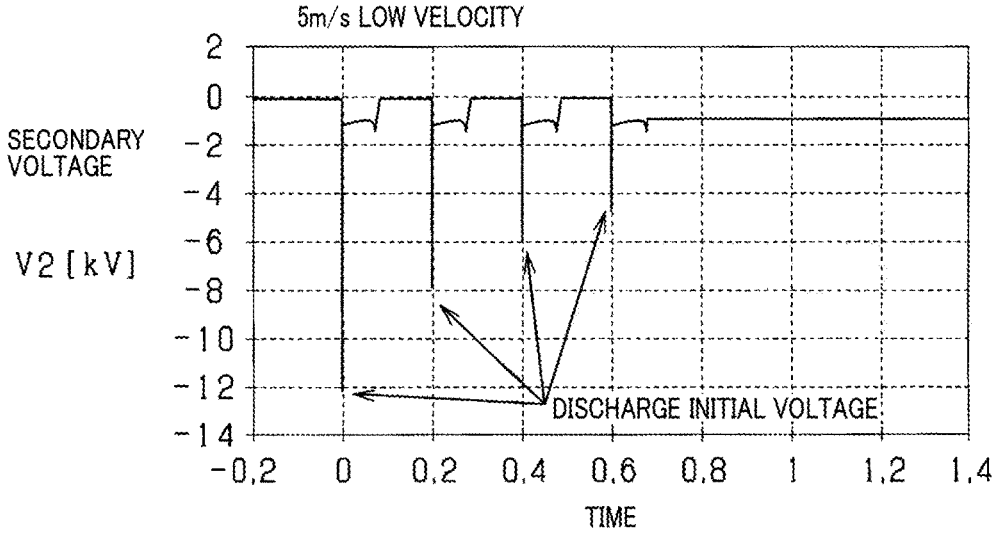
FIG. 11 is a diagram showing a change of a secondary voltage V2 under low speed air/fuel conditions when the primary current is continuously flowed at a compression period.
Figure 12:
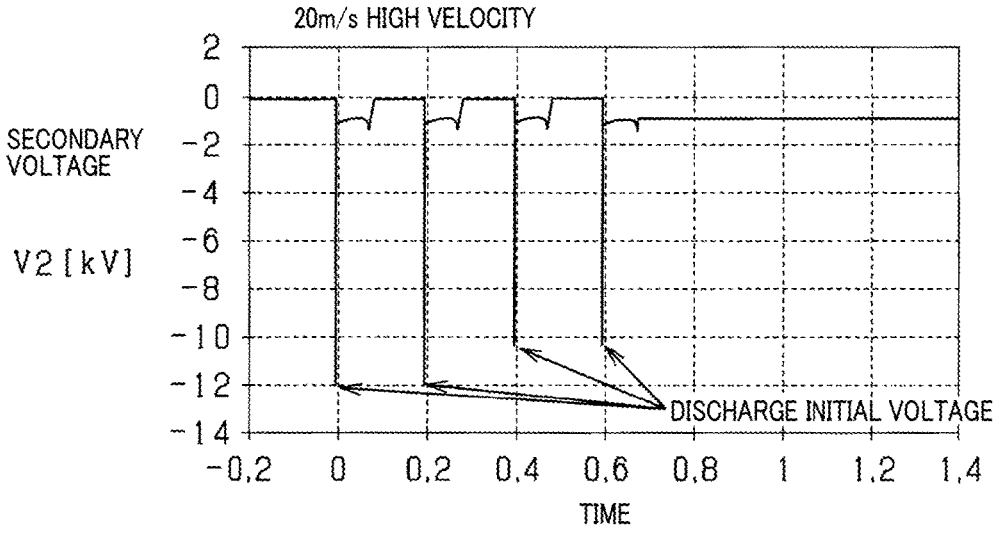
FIG. 12 is a diagram showing a change in the secondary voltage under fast air/fuel flow conditions when the primary current is continuously supplied at the compression period.

A change in the secondary voltage V2 when the ignition signal IGT is repeatedly switched on and off before the initiation time of the ignition is shown in FIG. 11 and FIG. 12. Specifically, FIG. 11 shows the change of the secondary voltage V2 when the flow speed of the air/fuel mixture is low (5 m/sec) and FIG. 12 shows a change in the secondary voltage V2 when the speed of the air/fuel mixture is high (20/sec).

In the case of where the speed of the air/fuel mixture is low (5 m/sec) a first discharge initial voltage is approximately 12 kV, a second discharge initial voltage is approximately 8 kV, a third discharge initial voltage is approximately 6 kV and a fourth discharge initial voltage is approximately 5 kV as shown in FIG. 11. In the case of where the speed of the air/fuel mixture is high (20 m/sec), a first discharge initial voltage is approximately 12 kV, a second discharge initial voltage is approximately 12 kV, a third discharge initial voltage is approximately 10 kV and a fourth discharge initial voltage is approximately 10 kV as shown in FIG. 12. That is, the absolute value of the secondary voltage V2 is higher in FIG. 12 than FIG. 11. Specifically, the absolute value of the secondary voltage is larger when the air/fuel speed is high, that is 20 m/sec (meters per second), after the second discharge (discharge initial voltage) than when the air/fuel voltage speed is low, that is, 5 m/sec, after the second discharge (FIG. 11). Thus, detection of the speed of the air/fuel mixture is enabled based on the absolute value of the secondary discharge V2 (discharge initial voltage) after the second discharge.

Effects of the First Embodiment will next be Described.

In a case of the speed exceeding the predetermined first threshold, the blow off of the spark plug easily occurs due to the airflow. Once the ignition discharge is dissipated, an ignition discharge is regenerated between the electrodes of the spark plug 30. The spark discharge has low contribution to the ignition due to the large heat loss caused by heat conduction to the spark plug 30 when the ignition discharge and the capacitive spark regenerate the initial flame. At this point, if energy remains in the ignition coil 10, (that is, before total energy accumulated in the ignition coil 10 is discharged) the ignition coil 10 is configured such that the first discharge is terminated, and regeneration of the discharge is produced, after the energy is accumulated in the ignition coil 10.

Incidentally, by terminating the first discharge, energy accumulated in the ignition coil 10 is useable for the second discharge. The energy accumulated in the ignition coil 10 is efficiently useable for ignition as a consequence and the charging period for the second discharge decreased, by utilizing the accumulated energy in the ignition coil 10. Specifically, the interval between the first and second discharge becomes shorter and the initial flames generated at the respective first and second discharge can combine, enhancing ignitability of the air/fuel mixture. Additionally, a shorter time period from the initial first discharge to the completion of the second discharge is achieved, and the plurality of ignition pulses can be performed, even when the rotating velocity of the engine is high and the initial combustion period is short.

Additionally, the same amount of energy accumulated in the ignition coil 1 at the initiation of the first discharge (predetermined energy) is accumulated at the initiation of the second discharge. The size of the flame generated at second discharge can be increased, and ignitability of the air/fuel mixture enhanced. At this point, the predetermined energy is set as maximum energy (fixed value) allowable to accumulate in the ignition coil 10.

Once the air/fuel mixture is ignited, the combustion increases with the speed of the air/fuel mixture. If the speed exceeds the second threshold, (higher than the first threshold), only a first discharge will be performed. The combustion level of the air/fuel mixture is maintained and exhaustion of the spark plug 30 is preventable.

On the other hand, if the speed falls below the predetermined threshold, dissipation of the spark discharge caused by the airflow is almost non-existent. In this case the total predetermined energy accumulated in the ignition coil 10 is used and the first discharge performed.

By only requiring a smaller amount of accumulated energy than the predetermined energy for the second discharge, a shorter charging period for the second discharge is achieved. As a further result, the interval between the first discharge and the second discharge is also shorter, and the initial flames generated at the respective first and second discharge are combined. The ignitability of the air/fuel ratio is thus enhanced. Additionally, a shorter time duration from the initial first discharge to the completion of the second discharge is achieved and the plurality of ignition pulses can be performed, even when the speed of the engine is high and the initial combustion period is short.

If the length of the initial combustion period is long enabling the operation of two discharges using the predetermined energy, the first discharge is produced using the total predetermined energy accumulated in the ignition coil 10. Additionally, the predetermined energy in the ignition coil 10 is accumulated and the second discharge is performed. In the configuration, under such conditions of low speed and the discharge path extending with difficulty, the total value of the discharge energy and the discharge time of the first discharge is maximized and the ignitability of the air/fuel mixture enhanced.

The electric charge in the ignition discharge is performed with difficulty, with a slower airflow in the air/fuel mixture, as a result, the electric discharge tends to easily remain after the discharge is completed. In this case, when the operation of the discharge is repeatedly performed, the secondary voltage V2 decreases after the second discharge. In this regard, the ignition apparatus is configured in which the speed of the airflow in the air/fuel mixture is detected based on the size of the secondary voltage V2 occurring with the interception of the primary current I1 in the compression stroke which includes the initial time of ignition. The supply and interruption of the primary current I2 is performed by switching the switching element 13 on and off. In this way, by detection of the speed in the compression stroke during the initiation of the ignition, an improved ignition control is enabled which is performed based on the speed, since the detected value of the speed and actual speed implemented during ignition are close in value. Additionally, during a period in which comparative pressure is low, for example, 60° before a top dead center (TDC), and by repeatedly continuing the discharge, a low secondary discharge can be maintained and the spark discharge enabled with certainty even when the pressure is high, for example, near the top dead center.

In the configuration described, the first discharge is terminated by allowing the primary current I1, before the secondary discharge I2 reaches the value in which the blow off of the spark discharge is predicted to occur. According to the configuration, repeated occurrence of the blow off of the spark discharge is suppressed. As a consequence, suppression of heat loss due to heat conduction to the spark plug 30 which is caused by regeneration of the discharged spark around the spark plug 30 can be achieved.

Additionally, the threshold of the secondary current I2 used to determine the blow off of the spark discharge is set larger with the increase of the speed. As a result, the primary discharge can be terminated with higher certainty, before blow off of the spark discharge occurs. Additionally, a shorter time duration from the initial first discharge to the completion of the second discharge is achieved and the plurality of ignition pulses enabled, even when the speed of the engine is high and the initial combustion period is short.

Second Embodiment

The first discharge is terminated before the blow off of the spark discharge occurs (that is, with energy remaining in the ignition coil 10). The ignition patterns shown in FIG. 4(*a*) are adapted, when the predetermined energy has accumulated in the ignition coil 10, however the ignition patterns shown in FIG. 4(*a*) of the regeneration discharge can be modified. Specifically, the configuration of which the first discharge is terminated before the blow off of the spark discharge occurs and an ignition pattern in which operation of the regeneration discharge is performed, after a lower amount of energy than the predetermined energy is accumulated in the ignition coil 10 can be employed.

Figure 13:
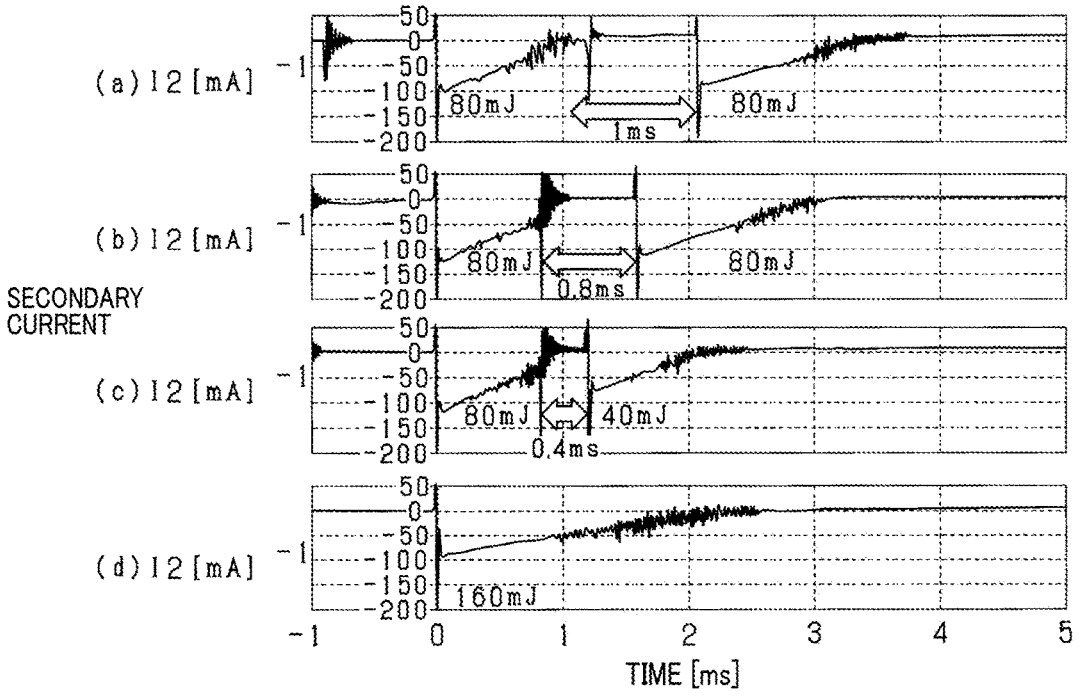
FIG. 13 are time charts showing a discharge patterns of the second embodiment.

As like FIG. 5(*c*), FIG. 13(*a*) two discharges patterns are performed, in which approximately 80 mJ of energy is discharged for both the first and the second discharge. After the first discharge, approximately 1 msec of charging to the ignition coil 10 is needed, and as a result, an approximate 1 msec interval occurs between the first discharge and the second discharge.

As like FIG. 5(*d*), the discharge pattern shown in FIG. 13(*b*) enforces two discharge patterns in which approximately 75 mJ is discharged in the first discharge and approximately 80 mJ of energy is discharge in the second discharge. After the first discharge, an approximate 0.8 msec of charging the ignition coil 10 is needed, thus, an approximate 0.8 msec interval occurs between the first discharge and the second discharge. In the discharge pattern shown in 13 the first discharge is terminated at a point in which the absolute value of the secondary discharge I2 reaches the predetermined current (value) of 50 mA, before the blow off of the spark discharge occurs.

The discharge pattern shown in FIG. 13(*c*) enforces two discharges in which approximately 75 mJ and approximately 40 mJ of energy are discharged in the respective first and second discharge. After the first discharge, a charging time of approximately 0.4 msec to the ignition coil 10 is needed and as a result, an approximate 0.4 msec interval thus occurs between the first and second discharge. Furthermore, in the discharge pattern shown in 13(*c*) the first discharge is terminated at a point in which the absolute value of the secondary current I2 reaches the predetermined current of 50 mA, before the blow off of the spark discharge occurs. Thereafter, a lower amount of energy than the predetermined energy (discharge energy of 40 mJ ) is accumulated in the ignition coil 10 and operation of the discharge is performed.

As like FIG. 5(*b*), only a single discharge is performed in the discharge pattern shown in FIG. 13(*d*). In the discharge, approximately 160 mJ of energy is discharged.

The EGR limiting value of each discharge pattern was compared. The EGR limiting value refers to a variable ratio of the mean effective pressure an upper limit value EGR ratio which is lower than the predetermined value (for example, 3%). The higher EGT limiting value means not only higher combustibility of the air/fuel mixture, but also higher ignitability of the air/fuel mixture. In a configuration in which only one discharge of 80 mJ is operated, the EGR limiting value was only 27.8%. The EGR limiting value of the discharge pattern shown in FIG. 13 (a) was 28.2%, and the EGR limiting values of the discharge patterns shown in the respective FIGS. 13(*b*), (*c*) and (*d*) were 28.4%, 28.6% and 28.8% respectively.

As a result, the first discharge is terminated before blow off of the spark discharge occurs (that is, with energy remaining in the ignition coil 10) and also after a smaller amount of energy than the energy accumulated at the initial point of the first discharge is accumulated in the ignition coil 10. The EGR limiting value is thus significantly enhanced in the ignition pattern (FIG. 13(*c*)) of the regenerated discharge. That is, not only the ignitability of the spark plug 30, but also stability of the engine output can be obtained.

Third Embodiment

In the third embodiment, the ECU 20 is the speed detector 20M (flow speed) which enables the generation of an alternative current, at the intake stroke directly before the compression stroke, by repeatedly switching the ignition signal IGT on and off, whereby the capacitive discharge or the spark discharge is generated at the ignition coil 10. The compression stroke includes the initial point of the ignition 10. The speed of the air/fuel mixture is thus detected on the basis of a generated frequency of the discharge.

Figure 14A:
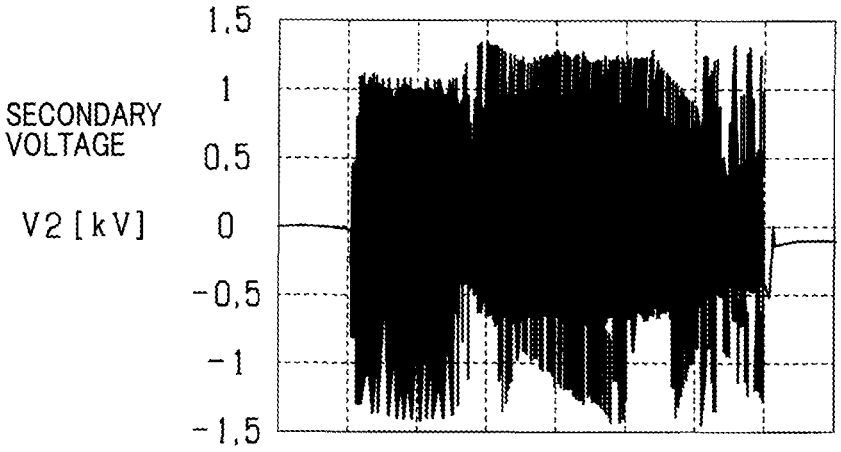
FIG. 14(A) and FIG. 14(B) are time charts showing changes in the secondary voltage and the secondary current when the primary current is allowed to continuously flow during an intake stroke.
Figure 14B:
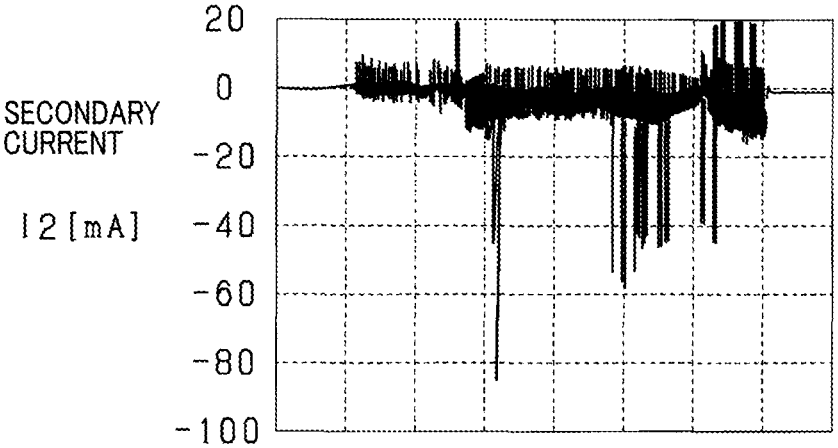

A change in the secondary voltage V2 is shown in FIG. 14(A) and a change in the secondary current I2 shown in FIG. 14(B), when an alternative current is applied. The ECU 20 is configured to determine the occurrence of a discharge when the absolute value of the secondary current I2 exceeds the predetermined value. Specifically, the ECU 20 acquires the capacitive discharge or the generation frequency of the spark discharge of the spark plug 30 based on the second current I2 flowing to the spark plug 30 caused by the capacitive discharge or the spark discharge. Additionally, the speed of the air/fuel mixture is detected based on the acquired discharge or the generation frequency of the spark discharge.

Fourth Embodiment

The ECU 20 is the speed detector 20M (flow speed detector) according to the fourth embodiment to sixth embodiment and detects the speed of the air/fuel mixture based on the secondary current I2 of the first discharge, the secondary voltage V2 or the first voltage V1. The FIG. 15 shows a waveform of the secondary current I2 and the secondary voltage V2 when the speed is low (broken line), and when the speed is high (solid line) in the first discharge.

A size of a resistance of the discharge path (discharge resistance) changes for the discharge at an initial combustion time period. That is, the size of the discharge resistance increases with the length of the discharge path. Additionally, since the discharge path extends with an increase of the air/fuel speed, the size of the discharge resistance also increases. In this regard, in the fourth embodiment, the speed of the air/fuel mixture is detected based on the size of the discharge resistance of the first discharge in the initial combustion time period.

Figure 15:
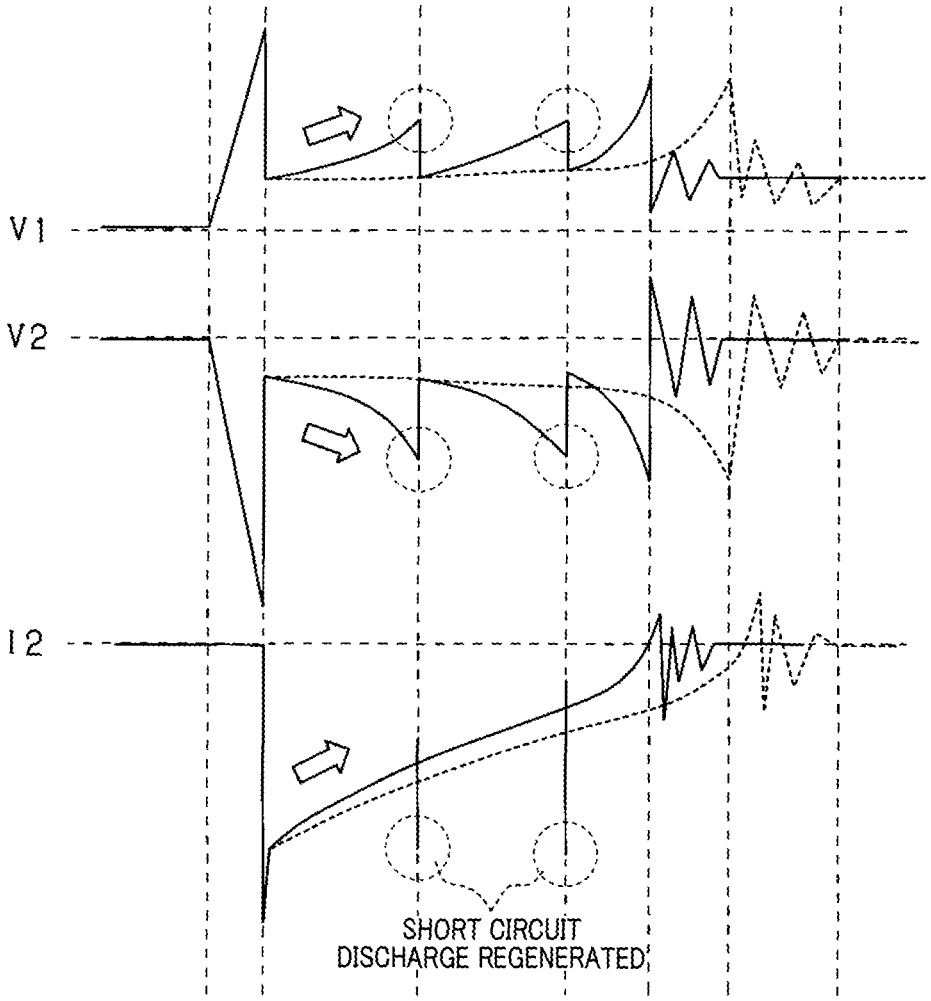
FIG. 15 is a time chart showing a change in the primary voltage, the secondary voltage and the secondary current during a first discharge.

As shown in FIG. 15, a time period of maintaining the discharge becomes shorter according to higher speed and larger discharge resistance. The ECU 20 detects a time length taken for the absolute value of the secondary current I2 to reach the predetermined current, and detects the speed of the air/fuel mixture based on the detected value.

Fifth Embodiment

The easy occurrence of the spark discharge short circuit changes, in accordance with the speed of the air/fuel mixture for the discharge during the initial combustion time period. Specifically, occurrence of the short circuited spark discharge increases with the increase of speed. As shown in FIG. 15, the flow of the secondary current I2 changes with the occurrence of the short circuited spark discharge. The ECU according to the fifth embodiment detects time until the short circuit occurs based on the secondary current I2 and detects the speed of the air/fuel mixture based on a detected value.

Once the short circuit of the spark discharge occurs, the secondary voltage V2 changes. That is, the time until the short circuit of the spark discharge occurs is detected based on the secondary voltage V2, and the speed of the air/fuel mixture is also detected based on the detected the detected value. However, since the secondary voltage V2 is markedly high, detection of the secondary voltage V2 becomes difficult when the discharge is produced in the spark plug 30. At this point, the time until the short circuit of the discharge occurs is detected based on the primary voltage V1 reflected from the secondary voltage V2, and the speed of the air/fuel mixture based on the detected value.

Sixth Embodiment

As was described in the fourth embodiment, as a result of the extended discharge path caused by the air flow, the resistance discharge increases according the increased speed of air/fuel mixture. As a further result, the size of the secondary voltage V2 of the ignition coil also increases with speed of the air/fuel mixture, as shown in FIG. 15. Specifically, the speed of the air/fuel mixture is detected based on the size of the secondary voltage V2.

However, since the secondary voltage V2 is markedly high, it is difficult to detect the secondary voltage V2 when the discharge is produced. At this point, the ECU 20 detects the speed of the air/fuel mixture based on the primary voltage V1 reflected from the secondary voltage V2. Additionally, the ECU 20 of the sixth embodiment is configured to integrate the primary voltage V1 value at a predetermined period and detect the speed of the flow of the air/fuel mixture, based on the integrated value. In using the integrated value, detection of the speed of the air/fuel mixture is enabled with good precision, even by using the primary voltage V1 which is reflected from the secondary voltage V2.

Other Embodiments

In the embodiments described above, the ignition apparatus is configured so that operation of one or two continuous discharges are performed in the spark plug during the initial combustion period. However, the configuration described can be modified so that more than 3 discharges are performed.

The configuration according to the first embodiment describes providing a smaller amount of energy than the predetermined accumulated energy at the initiation of the first discharge. As a result, shortening of a charging time for the second discharge can be realized, however, the described configuration can be omitted. In the same way, a configuration, in which, only the operation of a first discharge is performed, under the conditions of the speed exceeding the second threshold (i.e. more than the first threshold) can also be omitted.

The configuration in which, the determination value of the secondary current I2 is used to determine the blow off of the spark discharge, which is set to a large value with the increase of the speed, can be omitted. That is, the threshold of the secondary current I2 used to determine the blow off of the spark discharge can be a fixed value.

If the speed of the air/fuel mixture is higher than the first threshold, the configuration can be modified so that the first discharge is terminated before the detected value of the secondary current I2 reaches the determination value by comparison of the secondary current I2 and the determined value. That is, if the speed of the air/fuel mixture is higher than the first threshold, a configuration in which the discharge is terminated with energy remaining in the ignition coil 10 by a reduction of a predetermined time or a predetermined percentage from a standard value of the first discharge, may be employed.

DESCRIPTION OF SYMBOLS

10 . . . Ignition coil
10*a*. . . Primary coil
10*b*. . . Secondary coil
20 . . . ECU
30 . . . Spark plug

What is claimed is:

1. An ignition apparatus of an internal combustion engine characterized in that the ignition apparatus comprises:

an ignition coil provided with a primary coil and a secondary coil;

a spark plug igniting a combustible air/fuel mixture by shutoff of a primary current, after the primary current is supplied to the primary coil to generate an ignition discharge by a secondary voltage which is generated by the secondary coil;

a controller configured to perform a plurality of continuous discharges in the spark plug during an initial combustion period which is a period from an initial time of the ignition until a combustion ratio of the fuel contained in the combustible air/fuel mixture has reached a predetermined value, and a speed detector which detects a flow speed of the combustible air/fuel mixture, wherein the controller is configured to terminate the first discharge by supplying the primary current while having energy remaining in the ignition coil for the first discharge generated at the spark plug, which is initiated from the initial time of the ignition, when the flow speed detected by the speed detector exceeds a predetermined first threshold and a second discharge is implemented thereafter by shutting off the primary current.

2. The ignition apparatus according to claim 1, characterized in that:

the ignition coil accumulates a predetermined amount of energy at the initial time of the ignition by the supply the primary current, wherein:

the primary current is shutoff at a point in which the predetermined amount of energy has been accumulated in the ignition coil when the detected flow speed detected by the speed detector exceeds the predetermined first threshold after the first discharge is terminated and the second discharge is generated when the primary current is shutoff.

3. The ignition apparatus according to claim 1, characterized in that:

the controller is configured to shorten the period from the initial time of the ignition to the termination of the first discharge, when the flow speed detected at the speed detector is detected as being higher than a predetermined value, compared to the flow speed being lower than the predetermined value.

4. The ignition apparatus according to claim 1, characterized in that:

the controller is configured to accumulate the predetermined energy in the ignition coil from the initial point of the ignition by supply of the primary current, wherein, the first discharge is continuously generated by continuously shutting off the primary current until the predetermined energy is consumed, when the flow speed detected by the speed detector is detected as being lower than the predetermined first threshold, and the second discharge is generated thereafter in the spark plug by shutoff the primary current when a smaller amount of energy than the predetermined energy is accumulated in the ignition coil.

5. The ignition apparatus according to claim 4, characterized in that:

the controller is configured to continuously generate the first discharge by continuously shutting off the primary current until the predetermined energy is consumed in the first discharge, even if the flow speed detected by the speed detector is detected as being lower than the predetermined first threshold, when a length of the initial combustion period is longer than the predetermined threshold, and supply the primary current thereafter until the predetermined energy is accumulated in the ignition coil, at which point the supply of the primary current is shutoff and a secondary discharge generated.

6. The ignition apparatus according to claim 1, characterized in that:

the controller is configured to generate the first discharge only, when the flow speed exceeds the second threshold at the initial combustion time period.

7. The ignition apparatus according to claim 1, characterized in that:

the controller is configured to operate the supply of the primary current and the shut off of the primary current selectively, during either one of a compression stroke of the internal combustion engine, and an intake stroke, wherein:

the intake stroke occurs immediately before the compression stroke, the compression stroke of the internal combustion engine includes the initial time of the ignition pulses, and the controller detects the flow speed based on a current flowing to the spark plug, the current flowing to the spark plug by either one of a capacitive discharge and a spark discharge, the capacitive discharge and the spark discharge being generated by either one of a voltage generated at the spark plug and the shutting off of the primary current at the spark plug.

8. The ignition apparatus according to claim 7, characterized in that:

the controller is configured to operate the supply of the primary current and the shutoff of the primary current alternatively, during the compression stroke before the initial time of the ignition, wherein, the speed detector detects the flow speed based on either one of the capacitive discharge occurring due to the shutoff of the primary current, and the voltage generated at the spark plug during the initial time point of the spark discharge.

9. The ignition apparatus according to claim 7, characterized in that:

the controller is configured to perform either one of the supply of the primary current and the shutoff of the primary current in a plurality at the intake strokes, wherein, the speed detector acquires either one of a generated frequency of the capacitive discharge or a generated frequency of the spark discharge in the spark plug,—which occurs due to the shut off of the primary discharge, based on either one of the capacitive discharge occurring due to the shutoff of the primary discharge and the current flowing to the spark plug due to the spark discharge, and detects the flow speed on the basis of either one of the generated frequency of the capacitive discharge and the generated frequency of the spark discharge.

10. The ignition apparatus according to claim 1, characterized in that:

the speed detector detects the flow speed based on the current flowing in the spark plug during the first discharge.

11. The ignition apparatus according to claim 1, characterized in that:

the speed detector detects the flow speed on the basis of the voltage generated at the primary coil during the first discharge.

12. The ignition apparatus according to claim 1, characterized in that:

the controller is configured terminate the first discharge by supplying the flow of the primary current before a determination value of the current flowing in the secondary coil is reached, wherein, the determination value is value which predicts occurrence of a blow off of the spark discharge.

13. The ignition apparatus according to claim 12 characterized in that:

the controller is configured such that the determination value corresponds to an increase of the flow speed, wherein, the controller sets the determination value to be larger with the increase of the flow speed detected by the speed detector.

14. The ignition apparatus according to either claim 2, characterized in that:

the controller is configured to shorten the period from the initial time of the ignition to the termination of the first discharge, when the flow speed detected at the speed detector is detected as being higher than a predetermined value, compared to the flow speed being lower than the predetermined value.

15. The ignition apparatus according to claim 2, characterized in that:

the controller is configured to accumulate the predetermined energy in the ignition coil from the initial point of the ignition by supply of the primary current, wherein, the first discharge is continuously generated by continuously shutting off the primary current until the predetermined energy is consumed, when the flow speed detected by the speed detector is detected as being lower than the predetermined first threshold, and the second discharge is generated thereafter in the spark plug by shutoff the primary current when a smaller amount of energy than the predetermined energy is accumulated in the ignition coil.

16. The ignition apparatus according to claim 2, characterized in that:

the controller is configured to generate the first discharge only, when the flow speed exceeds the second threshold at the initial combustion time period.

17. The ignition apparatus according to claim 2, characterized in that:

the controller is configured to operate the supply of the primary current and the shut off of the primary current selectively, during either one of a compression stroke of the internal combustion engine, and an intake stroke, wherein:

the intake stroke occurs immediately before the compression stroke, the compression stroke of the internal combustion engine includes the initial time of the ignition pulses, and the controller detects the flow speed based on a current flowing to the spark plug, the current flowing to the spark plug by either one of a capacitive discharge and a spark discharge, the capacitive discharge and the spark discharge being generated by either one of a voltage generated at the spark plug and the shutting off of the primary current at the spark plug.

18. The ignition apparatus according to claim 2, characterized in that:

the speed detector detects the flow speed based on the current flowing in the spark plug during the first discharge.

19. The ignition apparatus according to claims 2, characterized in that:

the speed detector detects the flow speed on the basis of the voltage generated at the primary coil during the first discharge.

20. The ignition apparatus according to claim 2, characterized in that:

the controller is configured to terminate the first discharge by supplying the flow of the primary current before a determination value of the current flowing in the secondary coil is reached, wherein, the determination value is value which predicts occurrence of a blow off of the spark discharge.

* * * * *